United States Patent [19]

Galvan et al.

[11] Patent Number: 5,063,924

[45] Date of Patent: Nov. 12, 1991

[54] PROTECTIVE DEVICE, INDIVIDUAL, PORTABLE, WITH TOTAL INSULATION AND CONTROLLED ATMOSPHERE

[75] Inventors: Dino Galvan, Roma; Gianfranco Marcoaldi, Bracciano; Elvio Antolini; Sabatino DeMeo, both of Roma, all of Italy

[73] Assignees: Comitato Nazionale Per La Ricerca e Per Lo Sviluppo Dell'Energia Nucleare E Delle, Rome; Energie Alternative Grenfil S.r.l., Imola, both of Italy

[21] Appl. No.: 578,825

[22] Filed: Sep. 7, 1990

[51] Int. Cl.[5] ..... A61G 10/02; A62B 31/00

[52] U.S. Cl. ..... 128/202.12; 128/200.24; 128/204.18

[58] Field of Search ..... 128/200.24, 202.12, 128/202.13, 204.18

[56] References Cited

U.S. PATENT DOCUMENTS

| | | | |
|---|---|---|---|
| 2,401,230 | 5/1946 | Colley | 128/298 |
| 3,185,149 | 5/1965 | Rentsch | 128/202.13 X |
| 4,509,513 | 4/1985 | Lascey | 128/202.12 |
| 4,949,714 | 8/1990 | Orr | 128/200.24 |

FOREIGN PATENT DOCUMENTS

| | | | |
|---|---|---|---|
| 970939 | 11/1958 | Fed. Rep. of Germany . | |
| 3004156 | 2/1980 | Fed. Rep. of Germany | 128/202.12 |
| 2203050 | 10/1988 | United Kingdom | 128/200.24 |

*Primary Examiner*—Edgar S. Burr
*Assistant Examiner*—Eric P. Raciti
*Attorney, Agent, or Firm*—Brodwy and Neimark

[57] ABSTRACT

A portable device allowing the rapid aiding of individuals suffering from difficulty in breathing, movement and communication, in a situation of environmental risk in the form of toxic and contaminating agents, said device comprising a wrapping of flexible material impermeable to gas, vapour, fumes, aerosol and dusts, a window in said wrapping, hermetically closed by a flexible transparent material for the visualization of the inside thereof, a box-shaped body in fluid communication with an extremity of said wrapping and carrying a system for the filtering, feeding and pressurization of the air, and at least one exhaust valve of the air in said wrapping.

6 Claims, 1 Drawing Sheet

PROTECTIVE DEVICE, INDIVIDUAL, PORTABLE, WITH TOTAL INSULATION AND CONTROLLED ATMOSPHERE

BACKGROUND OF THE INVENTION

1. Field of the Invention

The present invention regards a device comprising a protective, totally insulating wrapping allowing the rapid aiding of individuals suffering from difficulty in breathing, movement and communication, because of a situation of environmental risk, in the form of toxic and contaminating agents, such as fumes, acid vapours, dusts, aerosols, etc., the whole in an environment in any case impossible to enter under normal breathing conditions, while awaiting transfer to adequate sanitary structures.

2. Description of the Prior Art

Acute respiratory pathology has taken on and is taking on an ever-increasing importance in relationship to modern industrial development with the progressive extension of its ever-growing pollution by: aerosols, gases, radioactive substances, fumes, vapours, etc.

The risk of becoming a victim to accidents is therefore in continuous increase, and this imposes the necessity and also the opportunity of being able to give the victims of such accidents, on their work-sites and not only there, the most rapid and efficient aid, in the case of poisoning, intoxication, asphyxia and/or in other conditions of serious emergency.

This necessity can be found in all those situations in which a detrimental modification of the characteristics of the air takes place due to a percentage variation of the component parts of breathable air, through the active intervention of substances which are directly detrimental to the breathing apparatus, through the presence of damaging agents which act on the organism with particular biological mechanisms.

The term "acute respiratory insufficiency" defines a condition in which a malfunction of the respiratory apparatus compromises the oxygenation.

With a mortality rate of 20%, it remains one of the most serious pathologies found in the field of emergency medicine. The principle functions of the respiratory apparatus are the elimination of $CO_2$ and the passage of $O_2$ from the alveolar area to the lung capillary bed and therefore respiratory insufficiency can be described as the pathological condition resulting from an inadequate oxygenation and from an insufficient ventilation or from both these conditions.

Among the problems connected to the activity of emergency aid and first aid, in which it is necessary to act rapidly in order to avoid the respiratory apparatus of individuals suffering from shock being exposed for an intolerable length of time to a heavily toxic or in any case noxious environment, or for the aid of subjects suffering from burns, devices are presently known which presuppose that the victim himself be able to make full use of the emergency apparatus, or that there be a continuous and direct assistance by rescuers. The apparatuses which can be used, and which are at present on the market, in the light of present knowledge and as results from accurate bibliographic investigations, do not make totally and simultaneously possible the functional, potentials and technical characteristics which can be assumed as:

total isolation of the victim from the environment at risk;

automation of function;

possibility of rapid multiple rescue;

filtering, ventilation and pressurization system;

air conditioning;

supply of oxygen.

In fact, the individual protective apparatuses known, of which mention has been made hereinbefore, can be divided into two main categories: those protecting the respiratory tracts alone and those protecting the whole body. The first category includes both the filter systems and the closed circuit systems, whereas the second category includes, generally, only filtering or ventilating devices. The operational difficulties and the limits of said apparatuses can be seen in all those cases in which it is necessary to give emergency aid to a number of individuals (not self-sufficient) within the same environment in which oxygen is scarce or in any case in the presence of fumes, vapours, toxic pollution and/or radioactivity, etc.. For example, self-contained breathing units and externally fed masks require above all, operative self-sufficiency and direct experience of use; protective suits (filtered or ventilated), along with direct experience, require a time and accuracy to be put on which is unthinkable in the cases mentioned above; finally the existing protective wrappings, above all for military use, show a simple filter system activated by the victim himself.

Also known are mobile units provided with feeding systems for "medical" air, which can house victims during their transportation to the hospital, but the necessity of creating a controlled atmosphere corresponding to the large internal volume of said means renders the technical problem hard to resolve, given the limited space available.

To this can be added that the volume of the controlled atmosphere must be immune from fresh external contamination, which imposes the necessity of obtaining two fundamental specifications:

a) sealing of the controlled environment;

b) internal over pressurization against recontamination.

Said specifications are hard to provide for the inside of a normal mobile unit and therefore require the obligatory use of special mobile units which, given their high cost, will always represent a limited fraction of those normally in existance or available.

Thus, there is an ever greater demand and indispensible request, by the services of assistance and emergency, environmental intervention, rescue, etc., for the availability of a type of protective portable device in which the injured person can remain, in an environment having a controlled atmosphere, in the hypothesis that the atmosphere of the external environment in which the injury was sustained be contaminated by toxic or harmful substances, both gaseous or in the form of aerosols or dusts.

Medical experience in fact teaches that a great percentage of physical injuries can worsen if the lungs of the victim are not rapidly removed from any noxious agent present in the environment.

SUMMARY OF THE INVENTION

The object of the present invention is therefore that of providing an individual, portable, protective device, being capable of total insulation with a controlled atmosphere of simple and efficient use, the fundamental function of which is that of creating a suitable environment of reduced dimensions, in which an injured individual, including one suffering from burns, can receive the support necessary to overcome the critical phase relating to the period immediately following the accident while awaiting, even for some time, transfer to a suitable hospital.

BRIEF DESCRIPTION OF THE DRAWINGS

The present invention will be better described hereinbelow by the description of its preferred embodiment, given merely as a non-limiting example, with reference to the attached drawings, in which.

DESCRIPTION OF A PREFERRED EMBODIMENT

Figure 1:
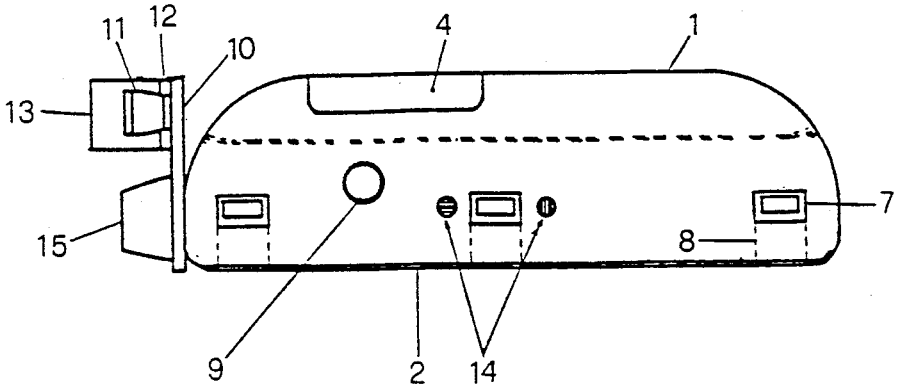
FIG. 1 is a side elevation view of the device in reference in an operating condition.
Figure 2:
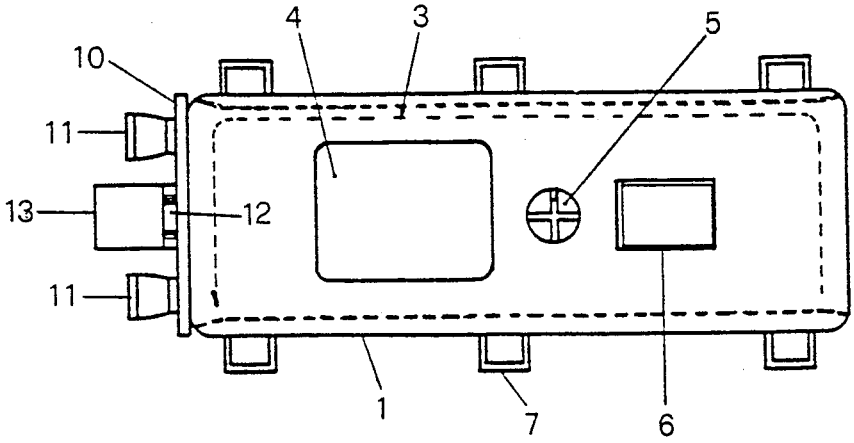
FIG. 2 is a top plan view of the device of FIG. 1.
Figure 3:
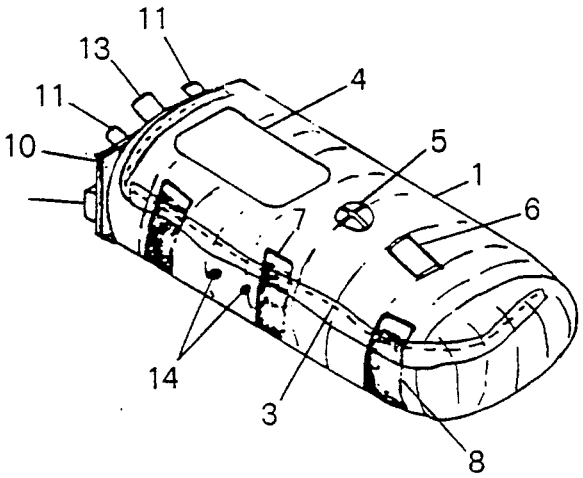
FIG. 3 is a perspective view of the device of FIG. 1.

With reference to the above figures, there is indicated with 1 a sack-shaped wrapping, with base 2 having a double-layer reinforcement, having in its operating condition, as shown in the figure a substantially hemicylindrical shape, so as to form a capsule totally insulated from the environment at risk for an injured person placed within it.

The wrapping 1 is formed of heat welded plastic material with particular characteristics of impermeability to gas, vapour, fumes, aerosol and dusts of high chemical-physical aggressiveness, also being tear-resistant.

Said material also shows extremely high decontamination characteristics by resorting to a simple watery liquid eventually with the addition of a small percentage of normal detergents.

The wrapping 1 is provided with a rapid opening and closing system, for example a zipper 3 extending along three sides of its upper surface, in which there is also provided a rectangular window 4 sealingly closed by a flexible transparent sheet material to allow the visualization of the inside of the wrapping 1 itself, a red cross on a white field 5 symbol of the organization for assistance and aid and a plastic bag 6 in which to place eventual notes relating to the patient being transported and which could be of use for the successive hospital therapy and also for identification.

On both the side surfaces of the wrapping 1 are mounted three handles 7 for manual transport, provided by means of respective belts 8 of flexible material fixed to the external surface of the wrapping 1, and on at least one of said side surfaces is provided the sealed installation of gloves 9 for internal manipulation, accessible from the outside, for example for cardiac massage.

The above described wrapping is associated to a system for the filtering, supply and pressurization of the air to be let into the inside, supported by a box-shaped member 10 in fluid communication with the head part of the wrapping 1 itself.

Said system comprises two filters 11, a microturbine 12 with a hermetically sealed micromotor of an explosion-proof type, electrically supplied by a rechargeable battery 13 screwed onto it, capable of providing an adequate flow rate of air within the inside of the wrapping 1 for the necessary ventilation and pressurization.

Alternatively, the microturbine 11 can also be supplied by an external electric source, either D.C. or A.C., by means of a suitable cable with adaptor, the insertion of which can automatically exclude the self-contained electric power supply, and vice versa.

The circulation of air is ensured by means of two pairs of exhaust valves 14, each one located on a respective side surface of the wrapping 1, said valves being provided with suitable filter systems.

In operation, the injured person is placed, following opening of the zipper 3, inside the wrapping 1 in a deflated condition and lying on the bottom 2. The zipper 3 is then closed, thus establishing within wrapper 1, a totally isolated environment into which air is blown through said filtering, feeding and pressurizing system.

The letting in of filtered air activates, after pressurization of the wrapping 1 has occurred, an efficient internal ventilation which, guaranteeing an adequate and continuous exchange of air, prevents the protective wrapping itself from misting, providing at the same time an efficacious state of well-being for the victim.

For eventual supplementary oxygenation of the victim it is possible to provide inside the wrapping 1 a small oxygen cylinder (not shown) capable of being inserted into the circuit feeding air by means of manual actioning from outside or from the inside by means of the manipulation glove 9.

When not in use the wrapping 1 in its deflated and folded condition can be housed in a container for this purpose forming part of the box-shaped body 10, a closure lid (not shown) being provided in such a way that the whole can assume the shape of a small case, easy to transport and store.

It must at this point be underlined that, in the air feeding circuit of the device according to the present invention, it is possible to insert, advantageously, an air-conditioning system, lodged in a space 15 protruding from the back of the box-shaped body 10, described in another patent by the same applicant entitled "MINIATURIZED AIR CONDITIONING APPARATUS" herein incorporated for reference.

Said system can be controlled by a microcomputer which analyzes, by means of sensors, the dynamic temperatures and performs pre-programmed adjustments, also displaying, automatically in sequence or on request, the values monitored on a small video display unit.

The present invention is not limited to the embodiment described, but comprises any variation thereof.

We claim:

1. A portable and collapsible hyperbaric chamber assembly adapted to accommodate a patient's entire body, said chamber comprising:

a flexible body capsule of a material substantially impermeable to gas, vapor fumes, aerosols and dust and resistant to tearing;

said flexible body capsule having an interior compartment;

handles attached to said body capsule;

rapid sealing means for opening and closing said flexible body capsule and respectively exposing or isolating said interior compartment from the ambient;

a window of a flexible, transparent material integral with said flexible body capsule;

a box-shaped frame fixed to said flexible body capsule;

an air filtering and pressurization means mounted on said box-shaped frame for pressurizing said interior compartment, said air filtering and pressurization means further comprises at least one filter, a microturbine, a sealed explosion-resistant micromotor, and an electric power source connected to said micromotor, said air filtering and pressurization means being connected in airtight, fluid communication with said interior compartment; and an over pressure valve sealingly attached to said flexible body capsule.

2. A portable and collapsible hyperbaric chamber assembly of claim 1 in which said flexible body capsule is of substantially hemicylindrical shape when in an operative condition.

3. A portable and collapsible hyperbaric chamber assembly of claim 1 in which said rapid sealing means is a zipper.

4. A portable and collapsible hyperbaric chamber assembly of claim 4 in which said electric power source is a battery.

5. A portable and collapsible hyperbaric chamber assembly of claim 1 in which said air filtering and pressurization means includes an air conditioner.

6. A portable and collapsible hyperbaric chamber assembly of claim 1 in which said flexible body capsule further comprises a plurality gloves, each having an interior, an exterior and a cuff;

said cuffs being sealingly affixed to said flexible body capsule;

said exteriors of said gloves being exposed to said interior compartment of said flexible body capsule;

said interiors of said gloves being in fluid communication with the ambient, for receiving the hands of an attendant for the manipulation of the patient.

* * * * *

UNITED STATES PATENT AND TRADEMARK OFFICE

CERTIFICATE OF CORRECTION

PATENT NO. : 5,063,924

DATED : November 12, 1991

INVENTOR(S) : GALVAN et al.

It is certified that error appears in the above-identified patent and that said Letters Patent is hereby corrected as shown below:

On the title page insert:

-- [30] Foreign Application Priority Data
Sep. 8, 1989 [IT] Italy .....35959B --

[73] Assignees:

Delete "Comitato Nazionale Per La Ricerca e Per Lo Sviluppo Dell'Energia Nucleare E Delle, Rome; Energie Alternative Grenfil S.r.l., Imola, both of Italy Insert therefor -- Comitato Nazionale per la Ricerca e per lo Sviluppo dell'Energia Nucleare e delle Energie Alternative, Rome; Grenfil S.r.l., Imola, both of Italy --

UNITED STATES PATENT AND TRADEMARK OFFICE

CERTIFICATE OF CORRECTION

PATENT NO. : 5,063,924

DATED : November 12, 1991

INVENTOR(S) : GALVAN et al

It is certified that error appears in the above-indentified patent and that said Letters Patent is hereby corrected as shown below:

| | |
|---|---|
| Column 6, line 3 | Delete "claim 4", insert therefor --claim 1--. |

Signed and Sealed this

Seventh Day of September, 1993

Bruce Lehman

*Attest:*

BRUCE LEHMAN

*Attesting Officer*

*Commissioner of Patents and Trademarks*